US005720063A

United States Patent [19]

Chacon

[11] Patent Number: 5,720,063

[45] Date of Patent: Feb. 24, 1998

[54] DRYWALL KNIFE HAVING A SCREWDRIVER BIT AND DIMPLE FORMING PROJECTION

[76] Inventor: Andres A. Chacon, 2019 Bayer Ave., Fort Wayne, Ind. 46825

[21] Appl. No.: 594,817

[22] Filed: Jan. 31, 1996

Related U.S. Application Data

[63] Continuation-in-part of Ser. No. 402,867, Mar. 13, 1995, abandoned.

[51] Int. Cl.[6] ..... B25B 15/00

[52] U.S. Cl. ..... 7/165; 7/105

[58] Field of Search ..... 7/105, 165; 81/438

[56] References Cited

U.S. PATENT DOCUMENTS

| | | | |
|---|---|---|---|
| 28,738 | 5/1860 | Hamlin . | |
| 180,187 | 7/1876 | Bartlett . | |
| 825,063 | 7/1906 | Lawbaugh . | |
| 832,455 | 10/1906 | Christensen . | |
| 1,597,464 | 8/1926 | Hebner | 7/105 |
| 2,092,586 | 9/1937 | Naumovich | 145/50 |
| 2,213,071 | 8/1940 | Keller | 30/169 |
| 2,839,110 | 6/1958 | Carpenter | 145/46 |
| 3,774,252 | 11/1973 | Cantales | 7/141 A |
| 4,658,457 | 4/1987 | Rokita | 7/105 |
| 5,063,627 | 11/1991 | Marra | 7/105 |
| 5,251,352 | 10/1993 | Cullison | 7/105 |

*Primary Examiner*—James G. Smith
*Attorney, Agent, or Firm*—Taylor & Associates, P.C.

[57] ABSTRACT

The present invention is directed to a drywall knife including a blade having an edge extending transversely to a longitudinal axis of the blade. A handle is attached to the blade, and a screwdriver tip is embedded within and rigidly attached to the handle. A dimple forming projection is attached to the handle and/or the screwdriver tip.

8 Claims, 2 Drawing Sheets

DRYWALL KNIFE HAVING A SCREWDRIVER BIT AND DIMPLE FORMING PROJECTION

CROSS REFERENCE TO RELATED APPLICATIONS

This is a continuation-in-part of U.S. patent application Ser. No. 08/402,867, by the same title, filed Mar. 13, 1995 abandoned.

BACKGROUND OF THE INVENTION

1. Field of the Invention

The present invention relates to fixed blade knives, and, more particularly, to fixed blade knives used for applying drywall mud to drywall.

2. Description of the Related Art

It is known in the art to provide a knife having a transversely extending edge and a screwdriver bit in the handle thereof for rotating a screw when necessary. For example, U.S. Pat. No. 3,774,252 (Cantales) discloses a spackling knife tool including a blade with an integrally formed shank portion. The shank portion includes a picture hanger removing slot therein and a screwdriver tip extending from the end thereof. A problem with such a design is that the screwdriver tip must be machined, stamped and/or ground into the shank portion of the knife blade, resulting in increased manufacturing costs of the knife tool.

It is also known to provide a knife having a transversely extending blade, and also having a screwdriver tip which is embedded within a handle which is rotatable relative to the blade. For example, U.S. Pat. No. 5,251,352 (Cullison) discloses a seven-way combination tool having a handle defined by two handle parts, each handle part being rotatable relative to the blade and including a screwdriver tip embedded therein. Each handle part may be rotated in a plane generally parallel to the working-edge of the blade, such that the screwdriver tip extends from the distal end of the tool. A problem with such a design is that a stamped member having a raised platform is interposed between the blade and the handle. The attachment point of the knife blade to the handle is therefore disposed at a distance away from the handle. Accordingly, when a rotational force is applied to the handle by a user to rotate a screw, a moment arm is induced between the handle part and the knife blade, which may result in permanent deformation thereof and dislocation between the handle and knife blade.

Finally, it is also known to provide a drywall tool with a screwdriver bit which is pivotally mounted within the handle thereof. For example, U.S. Pat. No. 5,063,627 (Marra) discloses a drywall knife having a handle which is rigidly affixed to the blade, and a screwdriver bit which is pivotally disposed within a slot formed in the side of the handle. The problem with such a design is that in order to use the screwdriver bit, it is necessary that a person use one hand to grasp the handle of the tool while using the other hand to pivot the screwdriver about its pivot point to enable use thereof.

SUMMARY OF THE INVENTION

The present invention provides a drywall knife having a screwdriver tip rigidly attached to the handle, and a dimple forming projection attached to the handle and/or the screwdriver tip.

The invention comprises, in one form thereof, a drywall knife including a blade having an edge extending transversely to a longitudinal axis of the blade. A handle is attached to the blade, and a screwdriver tip is embedded within and rigidly attached to the handle. A dimple forming projection is attached to the handle and/or the screwdriver tip.

An advantage of the present invention is that a drywall screw can be rotated without moving the handle relative to the blade.

Another advantage is that a dimple can be formed in a drywall sheet using the knife of the present invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF TEE INVENTION

Figure 1:
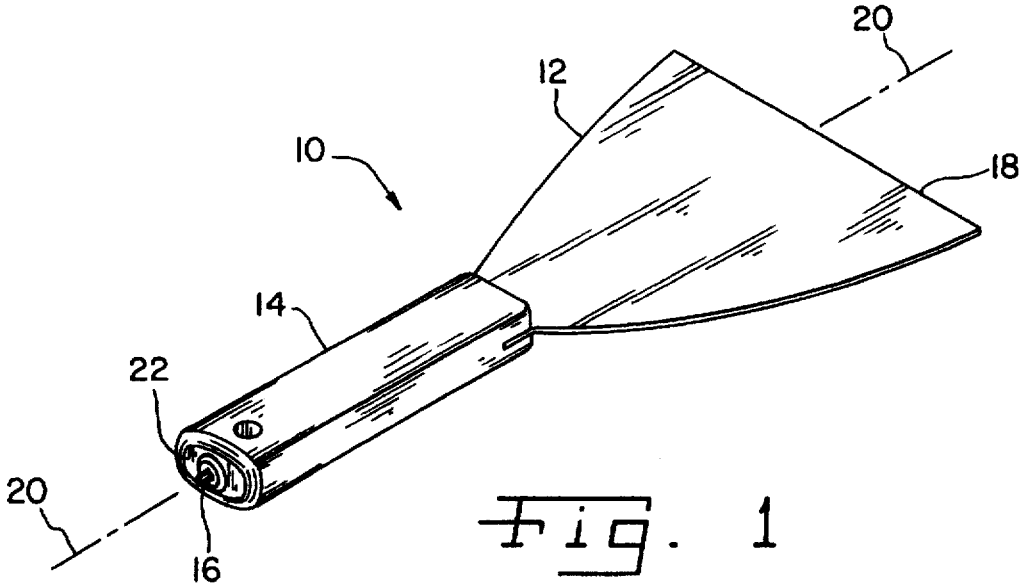
FIG. 1 is a perspective view of one embodiment of the drywall knife of the present invention.
Figure 2:
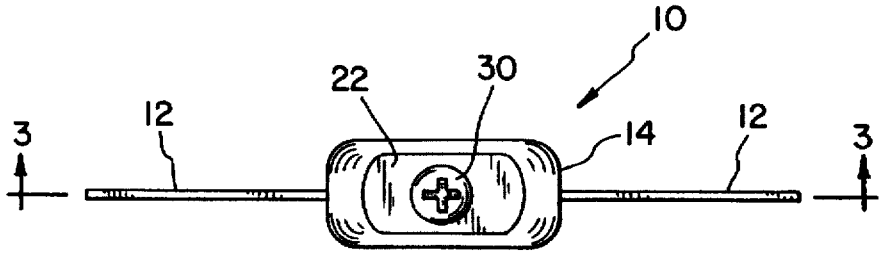
FIG. 2 is an end view of the drywall knife shown in FIG. 1.
Figure 3:
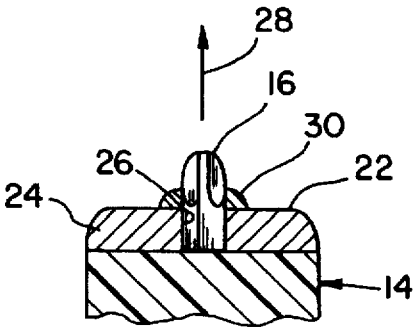
FIG. 3 is a fragmentary, sectional view taken along line 3—3 in FIG. 2.

Referring now to the drawings and more particularly to FIGS. 1–3, there is shown a drywall knife 10 of the present invention including a blade 12, handle 14 and screwdriver tip 16.

Blade 12 has an edge 18 which extends substantially perpendicularly to a longitudinal axis 20 of blade 12. Handle 14 is rigidly attached to blade 12 and is non-moveable relative to blade 12. Blade 12 includes in known fashion a tang portion (not shown) which extends into handle 14 and provides a surface for attachment between blade 12 and handle 14, such as by adhesives, fasteners or the like. Handle 14 has a distal end 22 which is disposed generally opposite from blade edge 18. Distal end 22 may be defined by a metal end cap 24 (FIG. 3) forming a part of handle 14. Distal end 22 of handle 14 includes a recess 26 configured to matingly receive screwdriver tip 16 therein. More particularly, recess 26 is sized slightly smaller than the cross sectional dimensions of screwdriver tip 16, whereby a frictional fit exists between recess 26 and screwdriver tip 16. Screwdriver tip 16 may be removed from handle 14 by applying an axial force thereto in the direction of arrow 28. Screwdriver tip 16 is configured in the form of a phillips head bit. It is to be understood, however, that other screwdriver tips, such as a slot head bit, could be utilized. Moreover, in the embodiment shown, screwdriver tip 16 is rigidly and removably attached to handle 14 via a frictional fit therebetween. However, it is to be understood that other methods of attachment therebetween are possible, such as a snap ring device or magnet disposed within handle 14.

Attached to screwdriver tip 16 is a dimple forming projection 30 having a semi-hemispherical shape. Dimple forming projection 30 is disposed generally coaxially about screwdriver tip 16 (FIG. 2), and functions to form a dimple in a drywall sheet, when desired. Although dimple forming projection 30 is shown being attached to screwdriver tip 16, it is also to be understood that dimple forming projection 30 could likewise be attached to distal end 22, or each of screwdriver tip 16 and distal end 22.

In use, blade edge 18 is used to spread drywall mud on drywall as needed. For example, drywall is typically fastened to wooden studs using drywall screws. Such screws are preferable to nails because they do not back out over time, and are usually driven into the drywall such that the distal end of the head is slightly below the surface of the drywall. The drywall mud is then applied over the head of the screw to cover the same utilizing blade edge 18. However, occasionally, the head of the drywall screw projects above the surface of the drywall and must be turned to move the head of the screw below the surface of the drywall. A user simply turns the drywall knife of the present invention around 180 degrees in their hand and rotates the drywall screw using screwdriver tip 16. No relative movement occurs between handle 14 and blade 12 (such as caused by induced moment arms or rotation between handle and blade), and single-handed operation is possible. Drywall knife 10 may again be simply rotated 180 degrees within the hand of the user to continue with application of the drywall mud using blade edge 18.

Figure 4:
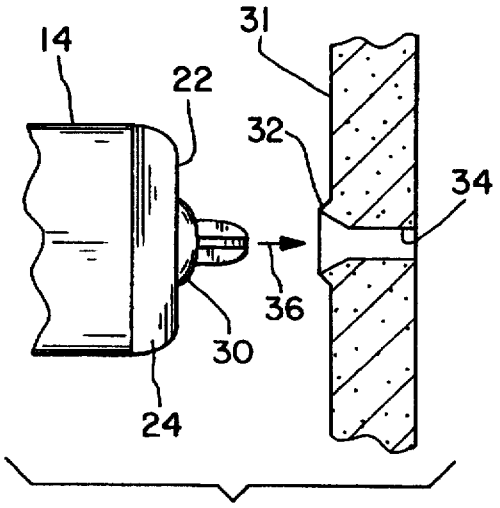
FIG. 4 is a fragmentary, side view of the handle portion of the drywall knife shown in FIGS. 1–3, as shown with respect to a screw hole in a sheet of drywall.

Referring now to FIG. 4, use of dimple projection 30 is illustrated. Occasionally, it is necessary to remove a drywall screw from a sheet of drywall 31. As indicated, this results in a raised shoulder 32 about the periphery of the hole from which the drywall screw is removed. Conventional practice is to strike shoulder 32 with a hammer to form a dimple within drywall sheet 31 over which a layer of drywall mud can be applied. Dimple forming projection 30 of the present invention allows a user to dispense with the use of a hammer to remove shoulder 32. More particularly, a user positions handle 14 such that screwdriver tip 16 is in generally coaxial alignment with hole 34. Handle 14 is then moved in the direction of arrow 36, such that dimple forming projection 30 engages shoulder 32. The user then rotates handle 14 slightly while applying an axial load against shoulder 32 with dimple forming projection 30. Such an application of force causes a dimple to be formed within drywall sheet 31 corresponding to the shape of dimple forming projection 30. Handle 14 is then moved in a direction opposite to arrow 36, and drywall mud is applied to the dimple formed within drywall sheet 31.

Figure 5:
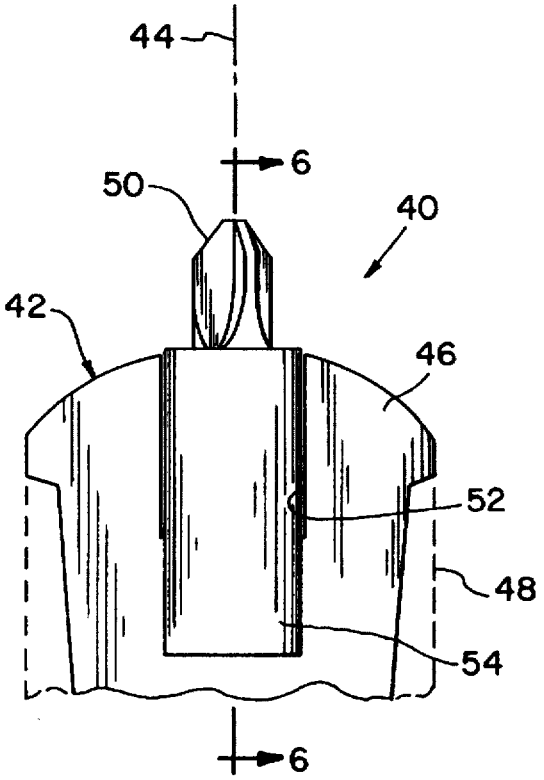
FIG. 5 is a fragmentary, plan view of another embodiment of a drywall knife of the present invention.
Figure 6:
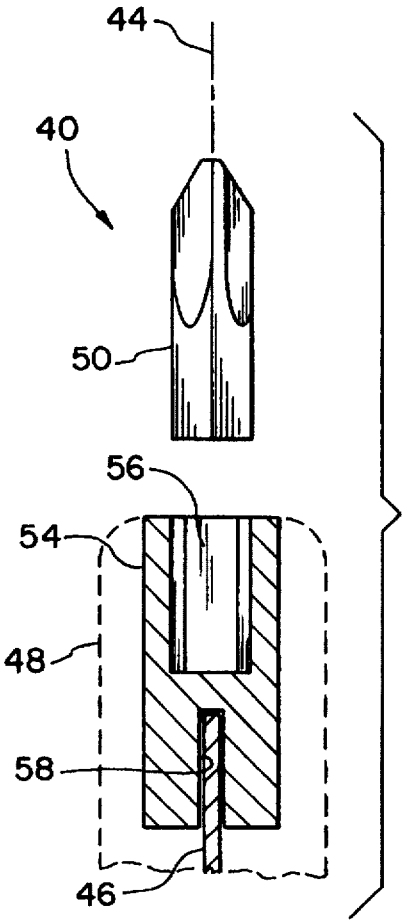
FIG. 6 is a side, sectional view taken along line 6—6 shown in FIG. 5.

Referring now to FIGS. 5 and 6, a fragmentary view of another embodiment of a drywall knife 40 of the present invention is shown. Drywall knife 40 includes a blade 42 having an edge (not shown in FIGS. 5 and 6) extending transversely to a longitudinal axis 44, similar to edge 18 shown in FIG. 1. Blade 42 is of one-piece construction and includes a tang portion 46 extending to or near an end thereof. A handle 48 (shown in phantom lines in FIGS. 5 and 6) is attached to tang portion 46.

A screwdriver tip 50 is attached to tang portion 46, whereby added strength is achieved. More particularly, in contrast with the embodiment shown in FIGS. 1 and 2 wherein screwdriver tip 16 is attached to handle 14, screwdriver tip 50 shown in FIGS. 5 and 6 is attached to tang portion 46. Since tang portion 46 is typically made from a metallic material (as opposed to a plastic material from which handle 48 is typically constructed), the amount of rotational force which may be applied to screwdriver tip 50 is increased.

Tang portion 46 may include a recess 52 in which a sleeve 54 is disposed. Sleeve 54 includes a recess 56 (FIG. 6) in which screwdriver tip 50 is removably disposed. Sleeve 54 may include a notch 58 which receives a part of tang portion 46 therein, such that sleeve 54 straddles either side of tang portion 46 as shown in FIG. 6. Sleeve 54 may be magnetized to define a magnetic sleeve for releasably holding screwdriver tip 50 in recess 56.

Figure 7:
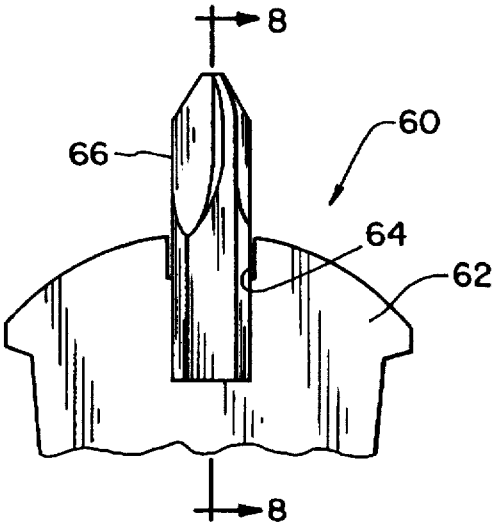
FIG. 7 is a fragmentary, plan view of another embodiment of a drywall knife of the present invention.
Figure 8:
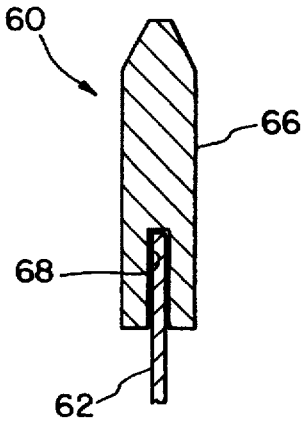
FIG. 8 is a side, sectional view taken along line 8—8 shown in FIG. 7.

Referring now to FIGS. 7 and 8, another embodiment of a drywall knife 60 of the present invention is shown. Drywall knife 60 includes a tang portion 62 having a notch 64, similar to tang portion 46 shown in FIGS. 5 and 6. A handle (not shown) may be attached to tang portion 62.

In contrast with the embodiment of drywall knife 40 shown in FIGS. 5 and 6, drywall knife 60 includes a screwdriver tip 66 having a notch 68 therein. Notch 68 receives a part of tang portion 62 therein, such that screwdriver tip 66 straddles either side of tang portion 46 as shown in FIG. 8.

Of course, screwdriver tips 50, 66 shown in FIGS. 5, 6 and 7, 8, respectively, may be in the form of a phillips head bit, straight head bit, or any other desired bit.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drywall knife, comprising:

a blade having an edge extending transversely to a longitudinal axis of said blade;

a handle attached to said blade;

a screwdriver tip embedded within and rigidly attached to said handle, said screwdriver tip including a shank portion; and a dimple forming projection attached to at least one of said handle and said screwdriver tip, said dimple forming projection disposed generally coaxially about said screwdriver tip.

2. The drywall knife of claim 1, wherein said handle is rigidly and non-movably attached to said blade.

3. The drywall knife of claim 1, wherein said dimple forming projection has a semi-hemispherical shape.

4. The drywall knife of claim 1, wherein said blade edge extends substantially perpendicular to said longitudinal axis of said blade.

5. The drywall knife of claim 1, wherein said screwdriver tip comprises a phillips head bit.

6. The drywall knife of claim 1, wherein said handle has a distal end disposed generally opposite from said blade edge, and wherein said screwdriver tip is embedded within and rigidly attached directly to said distal end.

7. A drywall knife, comprising:

a blade having an edge extending transversely to a longitudinal axis of said blade, said blade including a tang portion;

a screwdriver tip attached to said tang portion; and a sleeve attached to said tang portion, said sleeve including a recess therein, said screwdriver tip disposed within said sleeve, said sleeve further including a notch in an end thereof, said tang disposed within said notch.

8. The drywall knife of claim 7, wherein said sleeve comprises a magnetic sleeve for holding said screwdriver tip.

* * * * *